US006463940B1

(12) United States Patent
Thomas et al.

(10) Patent No.: US 6,463,940 B1
(45) Date of Patent: Oct. 15, 2002

(54) SMART RACK AND MACHINE SYSTEM

(75) Inventors: John E. Thomas, River Falls, WI (US); David Neal Demattia, Lindstrom; James L. Copeland, Apple Valley, both of MN (US)

(73) Assignee: Ecolab Inc., Mendota Heights, MN (US)

( * ) Notice: Subject to any disclaimer, the term of this patent is extended or adjusted under 35 U.S.C. 154(b) by 0 days.

(21) Appl. No.: 09/548,573

(22) Filed: Apr. 13, 2000

(51) Int. Cl.[7] ..... B08B 3/02

(52) U.S. Cl. ..... 134/56 R; 134/57 R; 134/113; 222/23

(58) Field of Search ..... 134/56 D, 57 D, 134/58 D, 113, 56 R, 57 R, 58 R; 222/23, 52; 700/90, 225, 242

(56) References Cited

U.S. PATENT DOCUMENTS 4,084,237 A * 4/1978 Beachem et al.
4,104,542 A * 8/1978 Karklys et al.
5,241,975 A 9/1993 Yanagiharaa ..... 134/56 D
5,383,482 A * 1/1995 Yamada et al.
5,388,299 A 2/1995 Lee
5,644,936 A 7/1997 Yasutake et al.
5,715,555 A 2/1998 Reber et al. ..... 8/158
5,743,209 A 4/1998 Bazin et al.
5,771,909 A * 6/1998 Hein et al.
5,886,648 A * 3/1999 McElroy et al.
5,897,671 A * 4/1999 Newman et al.

FOREIGN PATENT DOCUMENTS

DE 35 16 006 C1 8/1992
EP 0 619 395 A1 12/1994
GB 1 354 514 5/1974

* cited by examiner

*Primary Examiner*—Frankie L. Stinson
(74) *Attorney, Agent, or Firm*—Merchant & Gould P.C.

(57) ABSTRACT

A method and system provide an automated cleaning apparatus for cleaning various types of articles, wherein each type of article is detected and washed according to its own pre-determined combination. The cleaning apparatus has a storage device storing an array of pre-determined chemical combinations and cleaning parameters, including specifying cleaning chemicals to be used on the various identified article types. A transponder is provided with identifying information of the article type. A transceiver detects the type of article from the transponder and communicates that identifying information to a processor. Based on the detected identifier, the processor selects from the storage device the proper chemical combination and cleaning parameters for washing the identified type of article. A control device coupled to the processor delivers the chemicals specified by the selected chemical combination. Finally, a cleaning subsystem coupled to the processor cleans the articles using the delivered chemicals and other specified parameters.

14 Claims, 5 Drawing Sheets

FIG. 2

| Col. A | Col. B | Col. C | Col. D | Col. E | Col. F | Col. G | Col. H | Col. I |
|---|---|---|---|---|---|---|---|---|
| Identified Article Type | Chemical Types | Amount of each Chemical | Water Temperature | Water Type | Cycle order | Cycle Duration | Cycle Extension | Spray Pressure |
| Glasses | Detergent | 5 mls | 140 F | Soft | Wash | 45 Seconds Min | | medium |
| | Rinse Additive | 3 mls | 180 F | RO | Rinse | 9 Seconds Min | | medium |
| | Chlorine/Sanitizer | 50 ppm | 180 F | N/A | | N/A | | medium |
| Coffee Cups | Detergent/Cl2 | 5 mls/75 ppm | 140 F | Soft | Wash | 45 Seconds Min | +10 Seconds | medium |
| | Rinse Additive | 2 mls | 180 F | Soft | Rinse | 9 Seconds Min | | medium |
| | Chlorine/Sanitizer | 50 ppm | 180 F | N/A | | N/A | | medium |
| Pots and Pans | Detergent | 10 mls | 140 F | Soft | Wash | 45 Seconds Min | +20 Seconds | high |
| | Rinse Additive | 0 mls | 180 F | Hard | Rinse | 9 Seconds Min | | high |
| | Chlorine/Sanitizer | 50 ppm | 180 F | N/A | | N/A | | medium |
| Tableware | Detergent | 5 mls | 140 F | Soft | Wash | 45 Seconds Min | | medium |
| | Rinse Additive | 4 mls | 180 F | RO | Rinse | 9 Seconds Min | | medium |
| | Chlorine/Sanitizer | 50 ppm | 180 F | N/A | | N/A | | medium |
| Plates | Detergent | 6 mls | 140 F | Soft | Wash | 45 Seconds Min | | medium |
| | Rinse Additive | 4 mls | 180 F | Soft | Rinse | 9 Seconds Min | | medium |
| | Chlorine/Sanitizer | 50 ppm | 180 F | N/A | | N/A | | medium |

SMART RACK AND MACHINE SYSTEM

FIELD OF THE INVENTION

This invention relates generally to methods and systems for washing various types of articles, and in particular, to washing a particular type of article by associated pre-determined cleaning instructions.

BACKGROUND OF THE RELATED ART

Conventional dishwashers use hot water under pressure to both power its spray arms, and also to do the cleaning itself. To be effective, the water has to be sprayed in powerful jets from all directions so that it reaches all the articles. These are then rinsed by jets of clean water before drying.

In the typical dishwasher cycle, water enters through a water softener, which treats the water so that the dishes dry without marks. The water fills the base of the dishwasher. Cleaning chemicals are added which mix with the water. The hot water is pumped by the wash pump to the rotating spray arms. The hot water sprays the dishes and returns to the base of the dishwasher, where it is recycled after being filtered. After washing, the dirty water is pumped out of the dishwasher through a drain. The dishes are then rinsed and dried.

In more advanced systems, one is able to develop a washing process control procedure, which is read and interpreted, and subsequently controls the washing process in accordance with the interpreted washing control procedure. One of the problems with the current programmable systems are that the formulas have to be entered into a system before the washing. This can easily lead to misprogrammed information. Furthermore, this can be a very time-consuming, and therefore expensive operation. This is particularly true with dishwashers that are used in a cafeteria or restaurant setting when ease and efficiency are of the utmost importance in getting articles washed quickly and properly.

SUMMARY OF THE INVENTION

In accordance with the present invention, the above and other problems are solved by providing a smart rack and machine method and system wherein a particular type of article to be washed is identified. The type identification is communicated to a processor-controlled cleaning subsystem that washes the article according to the article type's own pre-determined chemical combination and other cleaning parameters.

In the present invention, an automated cleaning apparatus for cleaning one or more articles associated with an identifier is provided. The cleaning apparatus has a storage device storing an array of pre-determined chemical combinations specifying cleaning chemicals usable in the automated cleaning apparatus. A detector is positioned to detect the identifier associated with the articles or types of articles. A processor is coupled to the detector for selecting from the storage device a chemical combination for washing the articles, based on the detected identifier. A control device is coupled to the processor to deliver chemicals specified by the selected chemical combination. And, a cleaning subsystem is coupled to the processor to clean the articles using the delivered chemicals.

In use, the method for cleaning one or more articles using the automated cleaning apparatus is by providing in the storage device an array of pre-determined chemical combinations specifying cleaning chemicals usable in the automated cleaning apparatus. The identifier associated with the articles or types of articles is detected. Based on the detected identifier, a chemical combination for washing the articles is selected from the pre-determined array. The chemicals specified by the selected chemical combination are delivered to the automated cleaning apparatus. And, the articles are cleaned with the automated cleaning apparatus in accordance with the cleaning parameters from the pre-determined array.

The cleaning parameters may also include a specification of the spray pressures to be used for each article. The spray pressure is controlled, for example, by a pre-determined pump frequency setting, for example, RPMs, or by a manifold valve that diverts water from the sprayer.

While an embodiment of the present invention can be used in an automated cleaning apparatus to clean particular articles with pre-determined chemical combinations, it should be noted that the present invention could be adapted for use on other systems where tagging an article or a category of articles would be beneficial.

In sum, the present invention represents a significant improvement over the prior art automated cleaning apparatus systems in many ways. The automated cleaning apparatus system in accordance with the present invention allows for automated identification of articles or types of articles and the operation of a cleaning sequence with appropriate cleaning chemicals and cycles, and overcomes the disadvantages of the prior art. These and various other features as well as advantages, which characterize the present invention, will be apparent from a reading of the following detailed description and a review of the associated drawings.

BRIEF DESCRIPTION OF THE DRAWINGS

FIG. 2 illustrates an exemplary table of cleaning parameters located in a storage device of a possible embodiment of the present invention;

DETAILED DESCRIPTION OF AN EMBODIMENT

Figure 1:
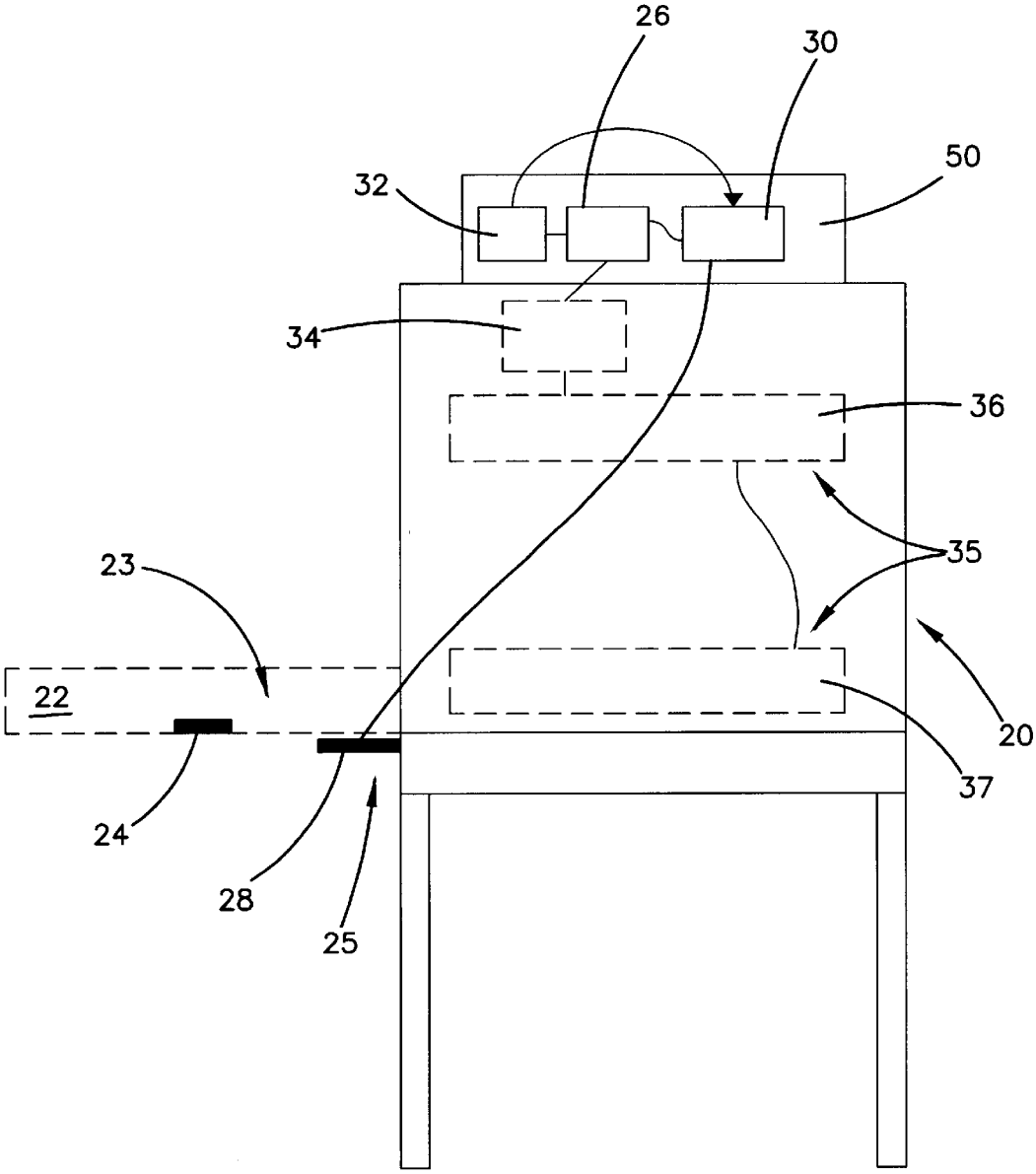
FIG. 1 illustrates the components of the automated cleaning apparatus in a possible embodiment of the present invention.

The present invention provides a method and system for an automated cleaning apparatus for cleaning articles according to the particular type of article's pre-determined chemical combination, and other cleaning parameters. Referring now to FIG. 1, which illustrates the components of the cleaning apparatus 20 in one possible embodiment of the present invention. The cleaning apparatus includes a rack 22 upon which the articles to be washed are placed. The cleaning apparatus may be a commercial dump and fill type dish machine with a standard dish rack, although other cleaning apparatuses may be employed, including without limitations animal cage washers used in animal research areas, as well as pot and pan washers used in large restaurants and bakeries.

Generally, a transponder 23, programmed with an identifier 24, is positioned on the rack 22. This will allow identification of the articles as a particular type of article for washing. Typically the transponder could be placed on the rack 22 or molded into the rack. A small injectable transponder (1/16"×1/2") would work best on a rack, in part because of its ease of placement on the rack. Also, while it would be possible to mold the transponder into the rack at the time the rack is manufactured, being able to retrofit existing racks may be desirable. In alternative embodiments, other sizes of transponders are acceptable.

The transponder 23 is preferably placed in the center of the rack 22. With center-placement of the transponder 23, the transponder will be able to identify the article-type regardless of the orientation of the rack 22 in the cleaning apparatus 20. In an alternative embodiment, a particular orientation of the rack 22 can be enforced by off-setting the transponder 23 on one side of the rack and off-setting the transponder antenna 28 appropriately.

This transponder 23 can be pre-programmed with unique identifying information, such as an identifier value indicating the type of rack being used, i.e., a rack designated for cups, plates, silverware, etc. An example of a transponder that may be used is Destron/IDI Injectable Transponder Model TX1400L. The Injectable Transponder is a passive radio-frequency identification tag, designed to work in conjunction with a compatible radio-frequency ID reading system. In an alternative embodiment, image identification could also be used, wherein each rack could be identified before it is received in the cleaning apparatus visually. An example of visual identification would be where the machine operator could have a choice of several different icons on a computer screen which will match the article type placed in the machine.

Identification of the articles could be done, for example, by use of specifically designed racks; by use of optical recognition; by use of bar codes; by color of the rack; by affixing a transponder to articles themselves; or by use of a proximity sensor. Examples of various types of articles include without limitation glassware, pots and pans, plates, cups, silverware, and coffee cups. Preferably, different racks typically are used for the different type articles. Types of articles associated with a common cleaning sequence can be grouped together in an embodiment of the presentation.

The cleaning apparatus of an embodiment of the present invention includes a transceiver 25, which is able to detect the type of article to be washed from the identifier 24, and communicate that identifying information to a processor 26. The transceiver 25 generally includes a transponder antenna 28 preferably located on the outer edge of the cleaning apparatus adjacent to the rack 22 and its transponder 23. The transponder antenna could also be located within the cleaning apparatus. The transceiver 25 also includes a transponder interface 30, which is coupled to the processor 26 in order for the identifying information to be received by the processor 26, and subsequently in order to be looked up in the storage device 32.

In one embodiment, the transponder 23 is placed on the bottom of the rack 22 and the transponder antenna 28 is built into the dish table. Each time the transponder 23 passes over the transponder antenna 28, the transponder antenna 28 wakes up the transponder 23 and the identifier 24 information stored in the transponder is transmitted to the transceiver 25. In one embodiment, a computer screen (not shown) can display the type of rack identified when the rack is passed over the transponder antenna 28. The computer screen display may also include further information such as the chemical formulation to be used for that article type, the date and time of detection, and any error in the wash process that has, or may, occur (e.g., out of detergent).

An alternative embodiment allows measuring of the rack weight, which could be used to determine loading efficiency by providing an indication of the number of items in a rack. This could be done by locating a scale near the entrance of the cleaning apparatus.

For the detector, a barcode scanner similar to the type used in a supermarket could also be utilized in an embodiment. An infrared scanner or proximity sensor could be used. Examples of scanners that may be used are Destron-Fearing Corporation's (of South St. Paul, Minn.) Pocket Reader and Pocket Reader EX Scanners. Corresponding bar codes are affixed to the rack for detection by the bar code scanner.

As mentioned, a processor 26 is typically coupled to the transponder interface 30. The processor 26 is used to select, from a storage device 32 (to be discussed in greater detail below), a pre-determined chemical combination, along with other cleaning parameters, for washing the particular article-type, based on the detected identifier 24. The processor 26, typically a Programmable Logic Controller (PLC), allows a custom formula of washing instructions to be set for each type of article being washed. For example when washing pots and pans a higher level of detergent may be needed, and the use of a rinse additive may not be required. Alternatively, a milder detergent and an increased level of rinse additive, for example, may be used for crystal.

The storage device 32 is used to store an array of pre-determined chemical combinations and cycle sequences and durations specifying cleaning chemicals to be used on the various types of articles. FIG. 2 illustrates an exemplary table of cleaning parameters located in a storage device of a possible embodiment of the present invention.

The storage device 32 could be considered a memory storage unit which includes an array for identifying information and a corresponding array of custom processing parameters. Such information associated with each article type could include corresponding chemical types to be used in the wash cycle, the amounts of each chemical to be used, the water temperatures to be used, the water type to be used, the cycle order, the cycle duration, and the spray pressure to be used. Water is a type of dilutant, which can be considered part of a chemical combination.

Preferably located in the storage device 32 are predetermined chemical combinations, in that once you have identified what type of article is in the rack 22, the cleaning apparatus can be controlled to wash that rack of articles according to specific, pre-determined parameters in a certain way. Some examples are as follows:

It can be seen from these examples that the combinations are numerous, once the article type in the rack is identified. For example, the detergent could be broken down into various chemical components and blended in accordance with a pre-determined chemical combination to fit the type of article being washed. The same could be done with the rinse additive.

FIG. 2 illustrates cleaning parameters located in the storage device 32 of a possible embodiment of the present invention. In Column A, the Identified Article Type is listed as an article-type, but could also be, for example, an identifying number or code corresponding to an identified article-type. When the type of article to be washed is detected from the identifier 24, that identifying information is communicated to the processor 26. The processor 26 then locates that identified article type in the storage device 32, as is illustrated here, to determine the wash formula to be used, as can be found in the corresponding row of the table.

In Column B, the Chemical Types employed are few in number, i.e. detergent, rinse additive, chlorine, and sanitizer. However, the Chemical Types could be, for example, a link list structure to allow the employed chemicals to be as large a number as required.

In Column C, the Amount of Each Chemical specified is an example of the amount of each specified chemical of Column B, to be used to create the desired chemical combination. The solutions of Column B can be combined as desired to compose a particular chemical combination.

In Column D the Water Temperature is specified. In one possible embodiment the water temperature is specified in degrees Fahrenheit. The water temperature may also be specified in degrees Celsius. In an alternative embodiment, the water temperature could be specified as a variation of plus or minus a certain degree from a pre-determined standard temperature In Column E, the Water Type, which is considered a component of a chemical combination, is specified. Water-type selections may include without limitation hard water, soft water, distilled water, or RO (reverse osmosis) water, and other water quality or water source selections.

In Column F, the Cycle Order is being specified. The Cycle Order could be, for example, a link list structure to allow Cycle Order combinations to be as numerous as required. In Column G, the Cycle Duration for each Cycle Order of Column F is given. In an embodiment of the present invention, the Cycle Duration in Column G is the minimum required by the National Sanitation Foundation ("NSF"). In Column H, the Cycle Extension is specified. This is given as a plus or minus amount based on the corresponding NSF duration given in Column G. In another alternative embodiment, the Cycle Duration may be a pre-determined standard set for a particular system. Other combinations of time durations can be used.

In Column I, the Spray Pressure is specified. In an embodiment of the present invention, the spray pressure is specified as either low, medium, or high. A medium spray pressure is typically programmed as a pump frequency setting, for example at either 1725 RPM or 3450 RPM, depending on the type of pump being used. The low and high settings are calculated as −50% and +50%, respectively, relative to the normal setting. Alternatively, the spray pressure settings control a manifold valve that diverts water from the sprayer.

In an alternative embodiment, the types of articles washed could be kept track of and printed out, which is an additional benefit for the customer. For example, the user could obtain information about the dates and times article types are washed, and be able to adjust cleaning supply inventories accordingly. Also, the peak periods of usage of the cleaning apparatus may be tracked and reported. This may be used by the user, for example, to evaluate labor requirements and keep down labor costs. These types of reports could be viewed and/or printed out in either text or graphical form.

With the formula optimized to the particular article type, additional benefits would include the ability to do such things as rinse a rack of glasses with additional rinse additive; use de-ionized water for final rinse on glasses; use a choice of water types relating to the water quality or the amount of dissolved solids, such as soft, hard, distilled, or RO water; addition of a bleaching agent to a final rinse to help control staining; use of additional detergent to wash pots and pans; fully optimize and blend formulas based on the article-type being washed; extend or shorten the wash time based on the article being washed; provide different final rinse options, for example, 180° F. for sanitizing, or deionized water for water spotting control. These would further result in fewer rewashes and less staining, along with more efficient cycle sequences and durations.

A control device 34 (FIG. 1) coupled to the processor 26 delivers the chemicals specified by the selected chemical combination, once the processor 26 has selected the chemical combination from the storage device 32. The control of the delivery of the chemicals can be achieved by such method as use of settable timers.

A cleaning subsystem 35 is coupled to the processor to clean the articles using the delivered chemicals. The cleaning subsystem 35 typically includes an upper cleaning subsystem 36 and a lower cleaning subsystem 37. The parameter setting of a particular article-type can include selection of use of either or both of the cleaning subsystems 36, 37 as well as the spray pressure to be used by the chosen cleaning subsystem. The spray pressure may be controlled by controlling the pump action or by use of a manifold valve (not shown). For example, when washing a lighter, plastic article, a lower spray pressure from the upper cleaning subsystem 36 may be desirable so as not to disorientate the article within the cleaning apparatus.

A type of cleaning apparatus that may be used for such an operation is a fill-and-dump type machine. In a fill-and-dump type machine, with every rack that is washed, the rinse water is fresh each time. At every rinse cycle the machine dumps and refills the machine with fresh water, treats it with a chemical, washes the articles, gets to the end of the cycle, rinses and dumps, and the refills again with fresh rinse water. This type of machine, therefore, gives the ability to control the water that goes into the wash tank, by, for example, adding enough detergent to have the water at a desired concentration. Or, other cleaning materials or chemicals could be added to the water, based on the article-type being washed. Another option may be to wash the entire cycle with fresh water.

Figure 3:
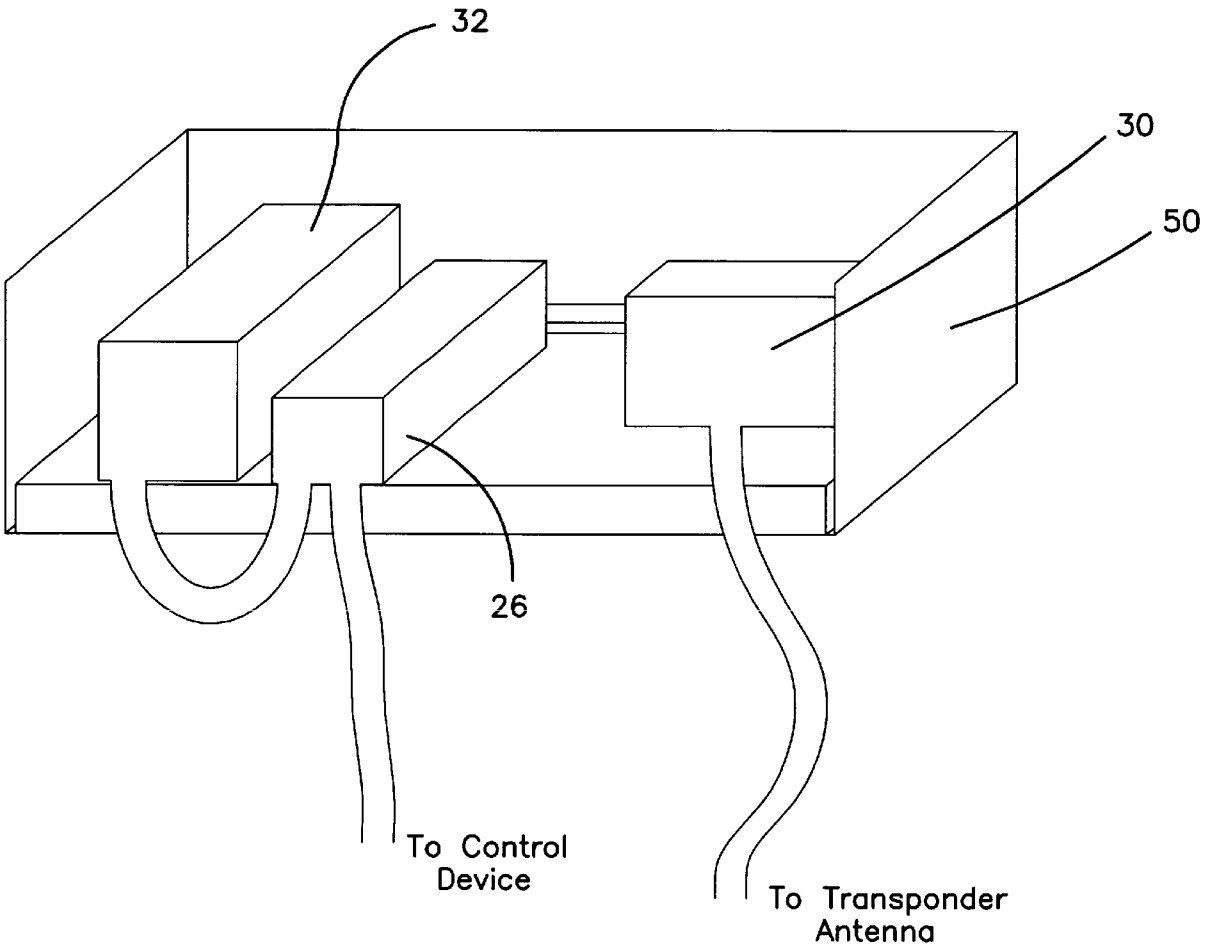
FIG. 3 illustrates an enlarged view of components of the control box, as shown in FIG. 1.

As shown in FIG. 3, the control box 50 of the present invention typically includes the processor 26, the transponder interface 30, and the storage device 32. When the transponder antenna 28 detects the identifier located on the rack (FIG. 1), the identifier 24 is communicated by the transponder interface 30 to the processor 26 to which it is coupled. The processor 26 is able to take the identifier and select from the storage device 32 any corresponding, pre-determined specifications and parameters (which may include without limitation chemical types and amounts, water temperatures and water type selection, cycle order, and cycle duration) on that particular article. A control device 34 (FIG. 1), also coupled to the processor 26, then delivers the specified chemicals, as well as executes any other parameters, being communicated by the processor 26. In one embodiment of the present invention, the specifications and parameters are communicated to relays (not shown), which operate the wash pump, the water heater, the chemical dispensing system, and indicator lights. In other embodiments, the cleaning subsystem can be controlled by a general purpose computer programmed to perform the operations of the control box 50, or may be connected as part of a network.

Figure 4:
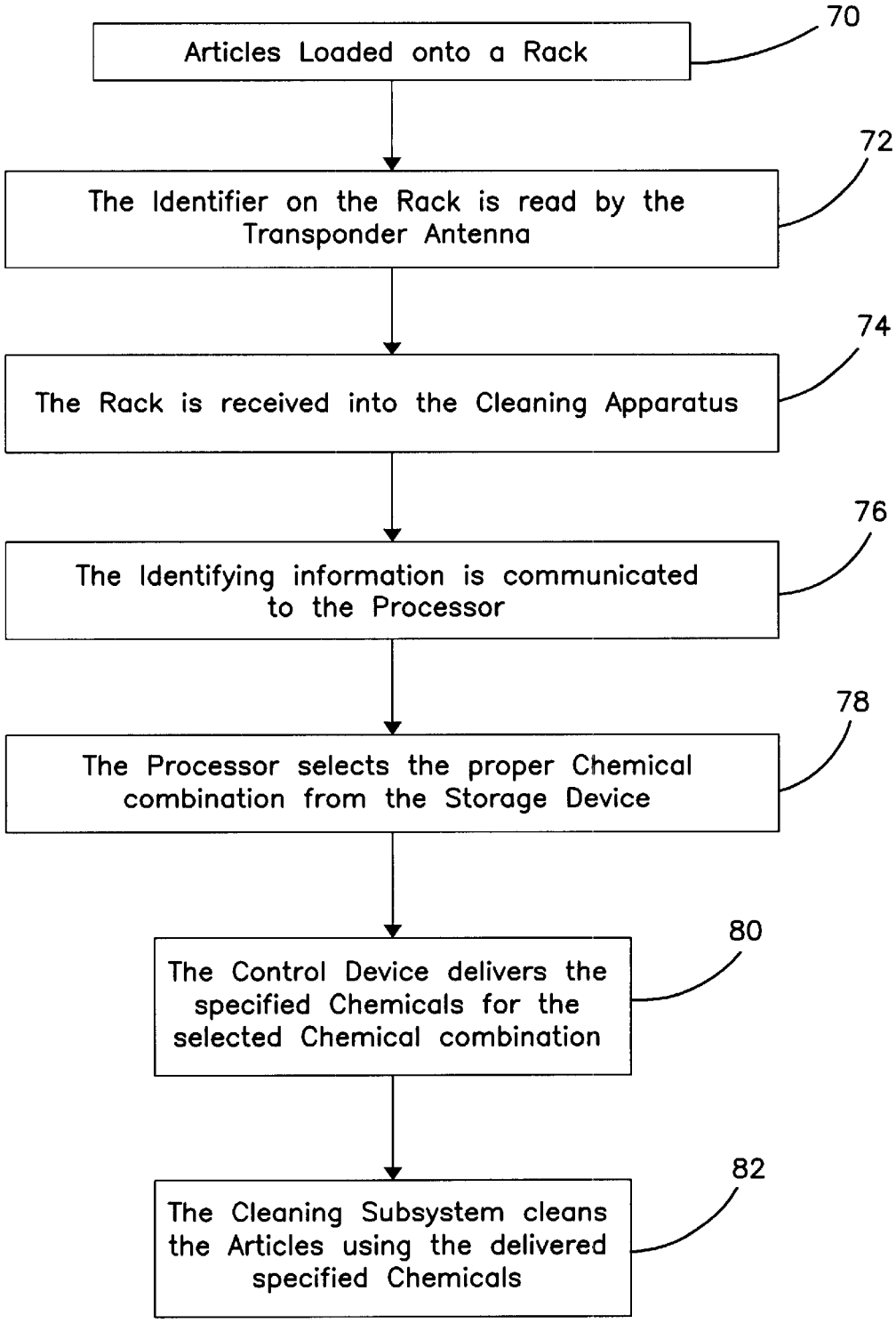
FIG. 4 illustrates the steps by which articles are washed by a pre-determined chemical formula, according to a possible embodiment of the present invention.

Referring now to FIG. 4, which illustrates the operations by which articles are cleaned with a pre-determined chemical combination, in an embodiment of the present invention. In operation 70, the articles are loaded onto a rack designated for a given type of article. The identifier 24 on the rack is detected by a transceiver's transponder antenna 28 in operation 72. In one embodiment, the transponder antenna is positioned at the outside edge of the cleaning apparatus, as shown in FIG. 1. The rack 22 is received into the cleaning apparatus in operation 74. In operation 76, identifying information read by the transceiver 25 is communicated to the processor 26 to which it is coupled. In operation 78, the processor then selects, from the storage device 32, the proper chemical combination for washing the articles, based on the detected identifier 24.

In one embodiment, the processor makes its selection of the proper chemical combination from the storage device when the door of the cleaning apparatus is closed after receiving the rack. Accordingly, the identification of the article type may be performed by the transceiver, but the selection of the proper chemical combination will not take place until closing of the door triggers the selection. Such a step ensures that the last identifying information read by the transceiver is the information used to select the chemical combination. With this system in place, an operator could make a mistake by inputting the wrong rack and subsequently change racks, and the correct identifying information is then used. In an alternative embodiment, triggering of the selection of the proper chemical combination may occur at other times. For example, the selection could be triggered by identification of the article type performed by the transceiver, and then merely overwritten if another identification occurs. Once selection is made, the control device 34, coupled to the processor 26, then delivers the specified chemicals for the selected chemical combination in operation 80. In operation 82, a cleaning subsystem 35, coupled to the processor 26, cleans the articles using the delivered specified chemicals.

Figure 5:
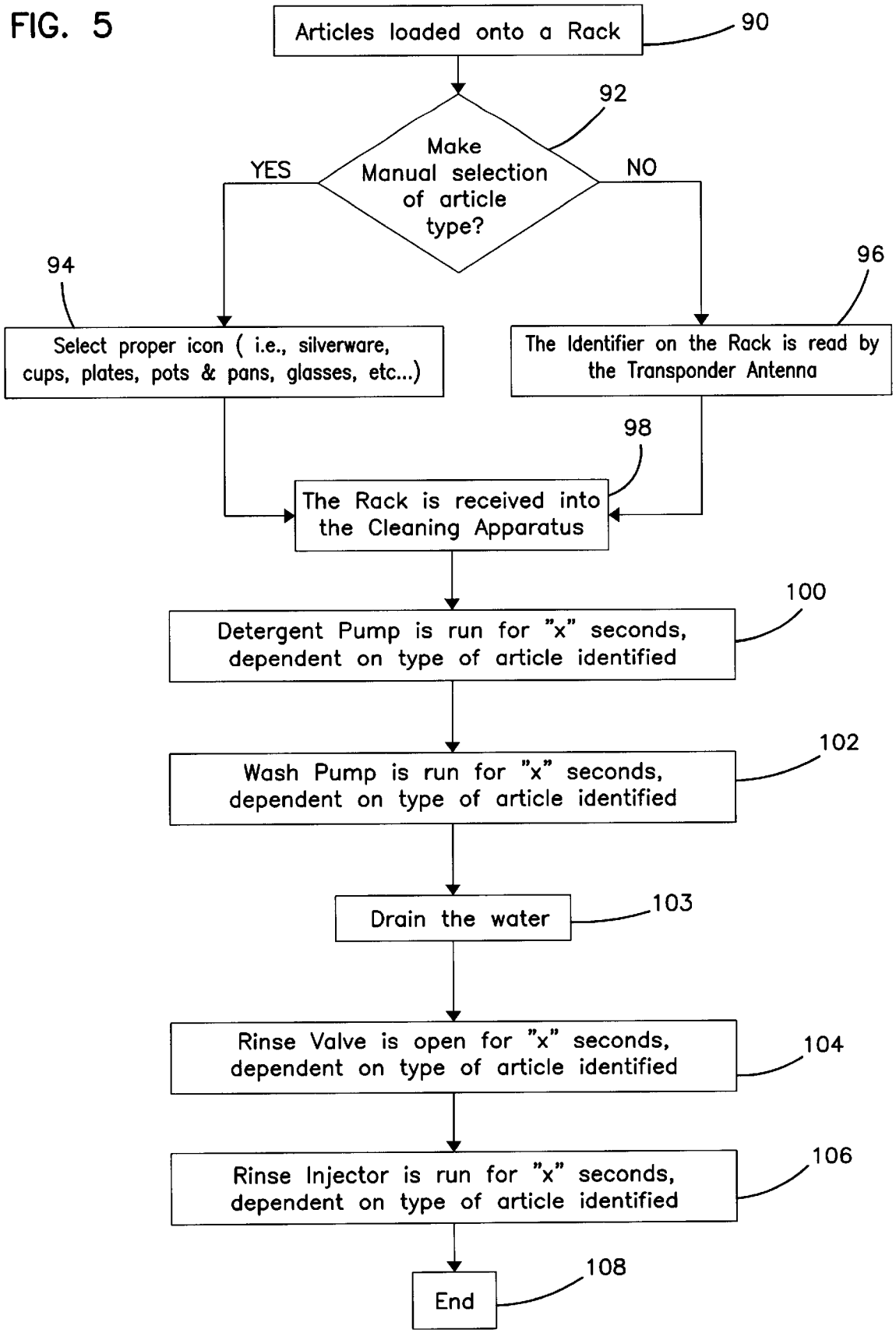
FIG. 5 illustrates the article-dependent, programmable operations of FIG. 4 in greater detail.

FIG. 5 illustrates the article-dependent, programmable operations of FIG. 4 in more detail. Generally, in operation 90, the articles are first loaded onto a rack 22. As discussed above, several article type selection techniques exist, as in operation 92. In one embodiment of the present invention, an operator may make a manual selection of the article type in operation 94. In another embodiment of the present invention, in operation 96, the article type may be identified by an identifier value and transceiver as discussed above. Or, in another embodiment, the operator may have the option of utilizing either the manual selection icons or the rack identifier as shown in FIG. 5. Once the type of articles is identified in one of these methods, the rack 22 is received into the cleaning apparatus in operation 98. In one embodiment of the present invention, in operation 100, a detergent pump is then run for a period of time specified in the table of storage device 32, that period of time being dependent upon which type of article is being washed. For example, the program may specify that cups and glasses take a first amount of detergent, flat ware takes no detergent, trays take a second amount of detergent, and pots and pans or plates and dishes take a third amount of detergent.

In one embodiment of the present invention, in operation 102, the wash pump is then run for a period of time, that period of time also being dependent upon which type of article is being washed. For example, the cleaning apparatus may be programmed that the wash cycle is run for an extended time for trays or pots and pans. The water is drained in operation 103. In operation 104, the rinse valve may then be opened for a period of time, that period of time being dependent upon which type of article is being washed 104. For example, it may be programmed that cups and flat ware receive a first amount of rinse additive, trays receive a second amount of rinse additive, pots and pans receive a third amount of rinse additive, and glasses or plates and dishes receive a fourth amount of rinse additive.

Finally, in operation 106, the rinse injector may be run for a period of time, that period of time also dependent on the type of article being washed 106. For example, it may be programmed that trays receive no sanitizer injection; pots and pans, glasses, flat ware, or plates and dishes receive a first amount of sanitizer; and that cups receive a second amount of sanitizer injection. Typically the wash process would then end in operation 108.

While the system hereinbefore described is effectively adapted to fulfill the aforesaid objects, it is to be understood that the invention is not intended to be limited to the specific preferred embodiments of the cleaning apparatus method and system set forth above. Rather, it is to be taken as including all reasonable equivalents to the subject matter of the appended claims.

What is claimed is:

1. An automated cleaning apparatus for cleaning one or more articles associated with an identifier, the one or more articles being stored in a storage structure, the apparatus comprising:

a storage device storing an array of chemical combinations specifying cleaning chemicals usable in the automated cleaning apparatus;

a detector positioned to detect the identifier associated with the articles;

a processor coupled to the detector for selecting from the storage device a chemical combination for washing the articles based on the detected identifier and triggered by closing of a door of the automated cleaning apparatus through which the storage structure is received into the automated cleaning apparatus;

a control device coupled to the processor to deliver chemicals specified by the selected chemical combination; and a cleaning subsystem coupled to the processor to clean the articles using the delivered chemicals.

2. The apparatus of claim 1 wherein the detector includes a transceiver capable of detecting the identifier.

3. The apparatus of claim 1 wherein the identifier is stored in and transmitted from a programmable transponder.

4. The apparatus of claim 1 wherein the identifier is affixed to a rack carrying the one or more articles.

5. The apparatus of claim 1 wherein the identifier identifies a type of article associated with a common chemical combination.

6. The apparatus of claim 5 wherein data, such as the type of article identified or time periods of usage of the automated cleaning apparatus, is tracked and reported in either a text or graphical format.

7. An automated cleaning apparatus for cleaning one or more articles associated with an identifier, the apparatus comprising:

a storage device storing an array of chemical combinations specifying cleaning chemicals usable in the automated cleaning apparatus;

a detector positioned to detect the identifier associated with the articles;

a processor coupled to the detector for selecting from the storage device a chemical combination for washing the articles, based on the detected identifier;

a control device coupled to the processor to deliver chemicals specified by the selected chemical combination; and a cleaning subsystem coupled to the processor to clean the articles using the delivered chemicals, wherein the chemical combinations stored in the storage device include further parameters specifying water type, water temperatures, cycle order, and duration of cycles.

8. The apparatus of claim 7 wherein spray pressure of the chemical combination is a parameter found in the storage device.

9. The apparatus of claim 8 wherein the spray pressure is controlled by a manifold valve.

10. The apparatus of claim 8 wherein the spray pressure is controlled by a pump frequency setting.

11. An automated cleaning apparatus for cleaning one or more articles associated with an identifier, the one or more articles being stored in a storage structure, the apparatus comprising:

a storage device storing an array of pre-determined parameters, wherein the pre-determined parameters include a water condition;

a detector positioned to detect the identifier associated with the articles; and a processor coupled to the detector for selecting from the storage device a water condition for washing the articles based on the detected identifier and triggered by closing of a door of the automated cleaning apparatus through which the storage structure is received into the automated cleaning apparatus.

12. The apparatus of claim 11 wherein the selected water condition is a type of water to be applied to the articles.

13. An automated cleaning apparatus for cleaning one or more articles associated with an identifier, the apparatus comprising:

a storage device storing an array of pre-determined parameters, wherein the pre-determined parameters include a water condition;

a detector positioned to detect the identifier associated with the articles; and a processor coupled to the detector for selecting from the storage device a water condition for washing the articles, based on the detected identifier, wherein the water condition is a selected spray pressure controlled by a manifold valve.

14. An automated cleaning apparatus for cleaning one or more articles associated with an identifier, the apparatus comprising:

a storage device storing an array of pre-determined parameters, wherein the pre-determined parameters include a water condition;

a detector positioned to detect the identifier associated with the articles; and a processor coupled to the detector for selecting from the storage device a water condition for washing the articles, based on the detected identifier, wherein the selected water condition is a spray pressure controlled by a pump frequency setting.

* * * * *